US007399216B2

(12) United States Patent
Mateo

(10) Patent No.: US 7,399,216 B2
(45) Date of Patent: Jul. 15, 2008

(54) METHOD, ADHESIVE SHEET, AND KIT CONFIGURED TO LIFT AND SHAPE A FEMALE HUMAN BREAST

(75) Inventor: Luz Mateo, Orlando, FL (US)

(73) Assignee: Moonlight Innovations, Inc., Orlando, FL (US)

( * ) Notice: Subject to any disclaimer, the term of this patent is extended or adjusted under 35 U.S.C. 154(b) by 83 days.

(21) Appl. No.: 11/367,801

(22) Filed: Mar. 3, 2006

(65) Prior Publication Data

US 2007/0218805 A1 Sep. 20, 2007

(51) Int. Cl.
*A41C 3/00* (2006.01)

(52) U.S. Cl. ..... 450/81; 450/1

(58) Field of Classification Search ..... 450/81, 450/86, 88, 92, 93, 54–57, 39, 41–45; 2/267; 604/385.07; 128/890, 889
See application file for complete search history.

(56) References Cited

U.S. PATENT DOCUMENTS 2,728,079 A * 12/1955 Williams ..... 450/81
2,793,369 A 5/1957 Panighini
2,844,151 A 7/1958 Lemons
3,276,449 A * 10/1966 Morgan ..... 450/81
3,934,593 A 1/1976 Mellinger
4,553,550 A * 11/1985 Hattori ..... 450/81
4,992,074 A * 2/1991 Diaz ..... 450/81
5,755,611 A * 5/1998 Noble et al. ..... 450/39
5,998,693 A * 12/1999 Zagame ..... 602/52
6,761,614 B2 7/2004 Pinna

OTHER PUBLICATIONS

American Society of Plastic Surgeons, "Mastopexy Breast Lift", http://www.plasticsurgery.org/public_education/procedures/Mastopexy.cfm, Feb. 4, 2006, 3 pages.
Embarrassingproblems.com, "Drooping breasts", http://www.embarrassingproblems.co.uk/breasts_b.htm, Feb. 4, 2006, 2 pages.

* cited by examiner

*Primary Examiner*—Gloria Hale
(74) *Attorney, Agent, or Firm*—Enrique J. Mora

(57) ABSTRACT

A method, adhesive sheet, and kit are provided to enable lifting and shaping to a female human breast. The kit may include a mushroom-shaped adhesive sheet comprising a curvilinear section and a rectangular section. The kit may further include a set of instructions for applying the adhesive sheet to a female human breast in conjunction with manipulations performed on the breast to provide lifting and shaping to the breast.

14 Claims, 4 Drawing Sheets

METHOD, ADHESIVE SHEET, AND KIT CONFIGURED TO LIFT AND SHAPE A FEMALE HUMAN BREAST

FIELD OF THE INVENTION

The present invention is generally related to correcting a sagging condition than can occur in a female human breast, and, more particularly, to a technique for applying an appropriately configured adhesive sheet to a female human breast in conjunction with manipulations performed on the breast to provide lifting and shaping to the breast.

BACKGROUND OF THE INVENTION

The sagging or drooping of breasts is a well-observed phenomenon that can affect many women at some point in their lives. This phenomenon can insidiously take its toll on women's breasts regardless of socioeconomic background and ethnicity. Women endowed with substantially small breasts are generally spared from experiencing sagging.

One notable cause of sagging may be due to breast mass involution. That is, when the internal milk making structures in the breasts shrink (e.g., loose volume) because such structures are no longer being used. For example, this may occur after weaning, or after giving birth, if one chooses not to breastfeed the newborn, or may occur in menopausal women due to hormonal changes. It is noted, however, that breasts may start a gradual drooping even at a relatively early age since breasts do not comprise muscle tissue. Breasts comprise ligaments and subcutaneous adipose tissue (fat). When the force of gravity pulls the breasts down, and, since such ligaments and the outer skin gradually loose their elasticity, the breasts loose their firmness, and consequently the breasts begin to droop. Another common cause for sagging may be due to weight loss. When a woman looses weight, the volume of fat tissue in the breasts is reduced. Typically, the outer skin and the internal ligaments do not adjust accordingly, and this can lead to a sagging condition.

Regardless of the specific cause of the sagging condition, women often experience self-confidence issues regarding the appearance of their sagging breasts. Accordingly, women may increasingly subject themselves to invasive and costly surgical procedures (e.g., mastopexy) in order to avoid—at least for some limited period of time—the sagging condition and improve the physical appearance of their breasts. As with any surgery, mastopexy carries some inherent risks, such as the possibility of bleeding and infection. Moreover, mastopexy generally results in noticeable and permanent scars. Also, the procedure can result in unevenly positioned nipples, and/or permanent loss of feeling in the nipples and other sections of the breasts. It is also common practice to use prostheses or accessories of various kinds applied to the breasts with the intention of causing a lifting effect. Typically, these accessories may require support by corselets, straps, shoulder straps or the like, and often an outside observer may easily detect their presence. Thus, it should be apparent from the foregoing discussion that there is a need to overcome the various disadvantages concomitant with known accessories and techniques that have attempted to correct a sagging condition in a female human breast.

BRIEF DESCRIPTION OF THE DRAWINGS

These and other advantages of the invention will be more apparent from the following description in view of the drawings that show.

DETAILED DESCRIPTION OF THE INVENTION

One aspect of the present invention provides a method for applying an adhesive sheet to a female human breast in conjunction with manipulations that may be conveniently self-performed by a female subject on her breasts to provide lifting and shaping to the breasts. Another aspect of the invention provides an adhesive sheet configured to provide lifting and shaping to the breast. In still another aspect thereof, the present invention provides a kit including an adhesive sheet and manipulating instructions to be performed on the breast to provide lifting and shaping to the breast.

The inventor of the present invention has innovatively recognized a method, an adhesive sheet, and a kit that will result in an aesthetically pleasing, and natural looking breast lift, without the need of undergoing costly surgical procedures, long-time recovery, and unnecessary pain or without having to use any conspicuous and burdensome support accessories.

Figure 1:
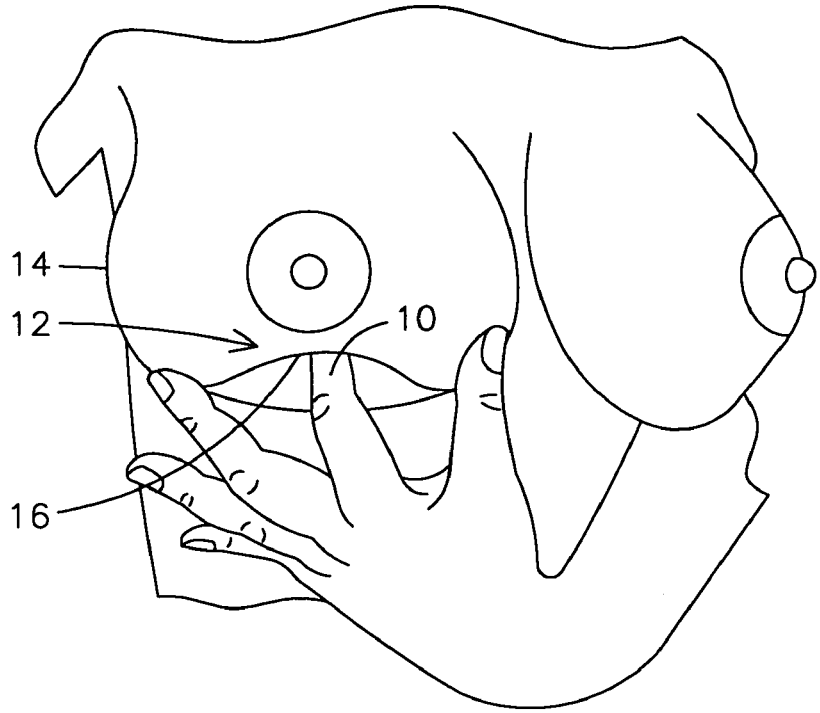
FIGS. 1-6 represent a sequential flow of graphical views for graphically illustrating exemplary steps for practicing a method in accordance with aspects of the present invention.

The description below, together with FIGS. 1 through 6, will be used to describe exemplary steps that may be self-performed by a female subject for practicing a method in accordance with aspects of the present invention. As shown in FIG. 1, in one exemplary embodiment a first finger 10, such as an index finger, is pressed against a lower central area 12 of a breast 14. This pressing forms a first channel 16 in the lower central area of the breast.

Figure 2:
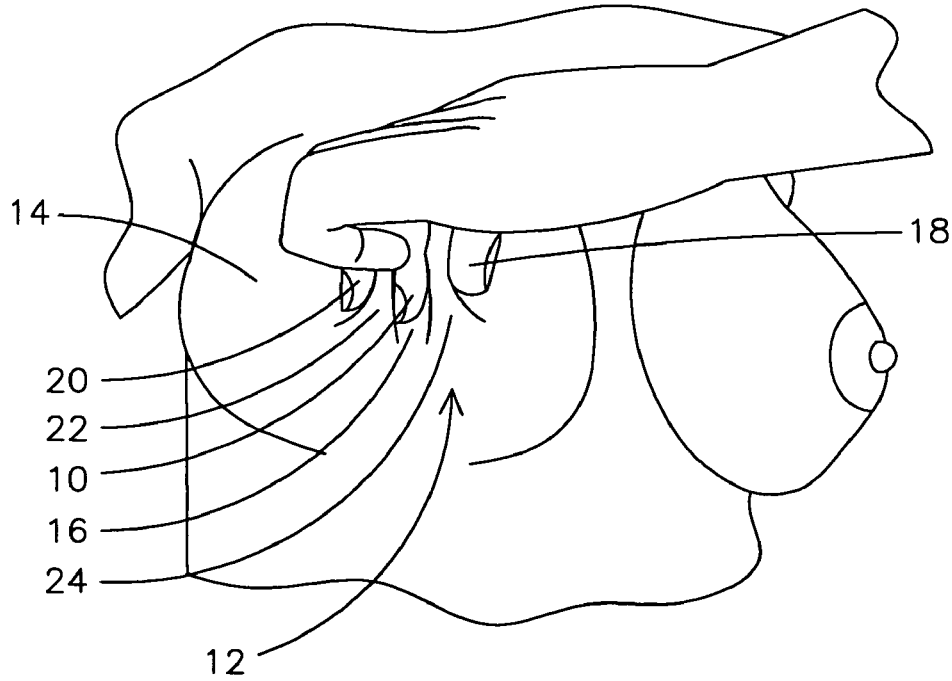

As shown in FIG. 2, a second finger 18, such as a thumb, and a third finger 20, such as a middle finger, are used to bring together to a compressed condition a first fold 22 of breast mass and a second fold 24 of breast mass that are respectively formed along mutually opposite sides of the first channel 16, as the first finger 10 presses against the lower central area of the breast.

Figure 3:
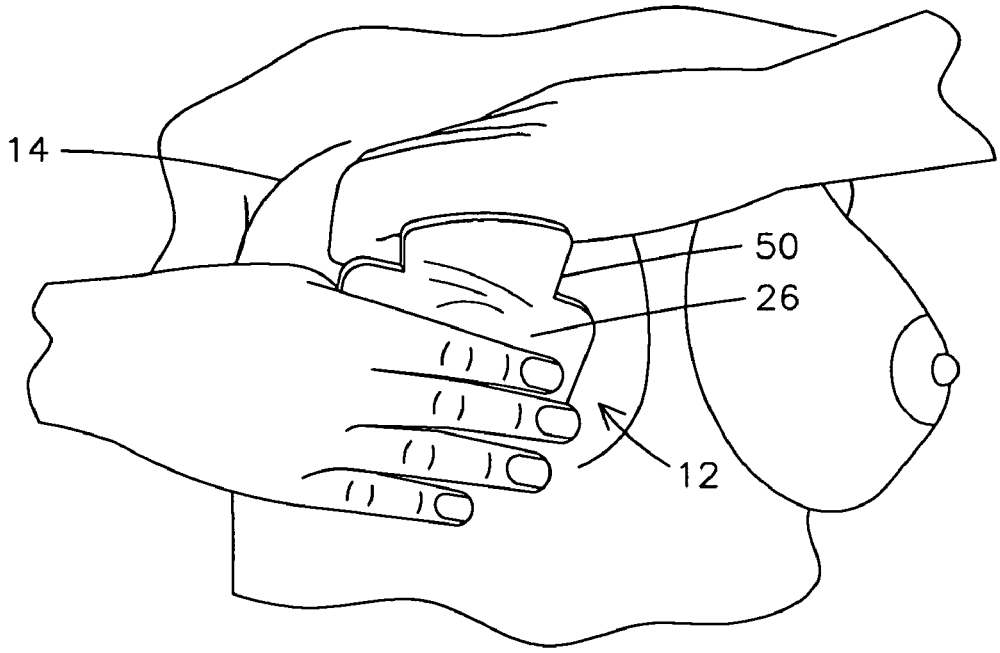

As shown in FIG. 3, a first section 26, e.g., a curvilinear section, of the adhesive sheet is applied to the lower central area of the breast to maintain the compressed condition in the first and second folds of breast mass, upon release of the first finger 10 from the lower central area of the breast. First section 26 corresponds to the upper section 52 in FIG. 7.

Figure 4:
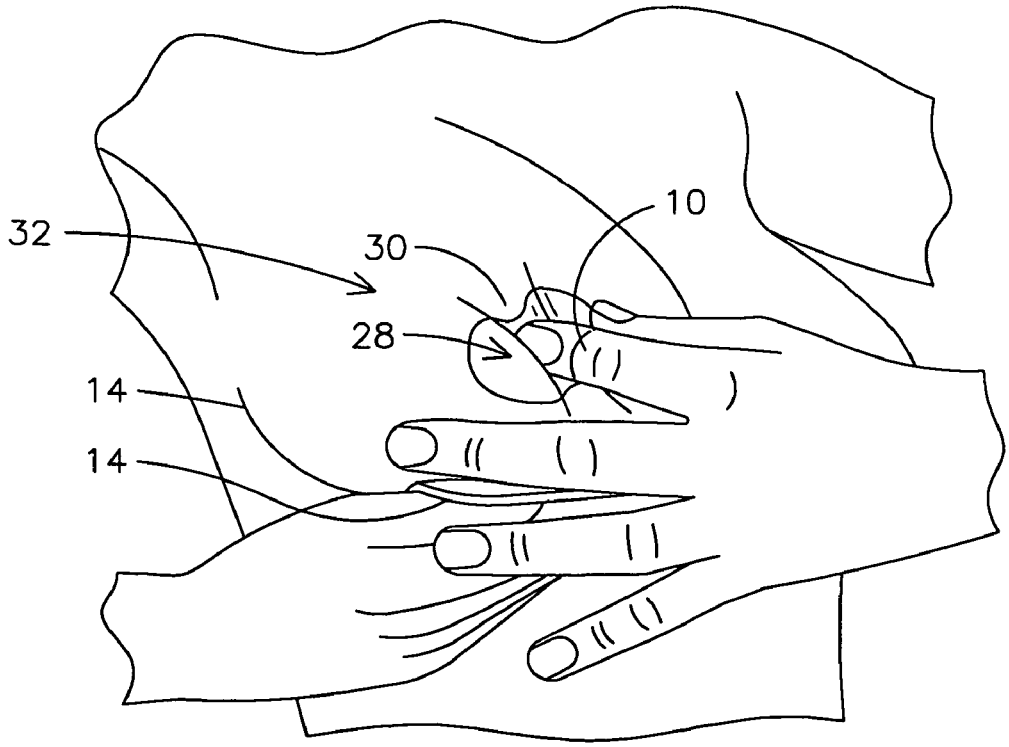

As shown in FIG. 4, the first finger 10, such as a then released index finger, is pressed against a nipple area 28 of the breast 14. This pressing forms a second channel 30 in an upper central area 32 of the breast. This may allow pushing the nipple into the second channel. In one exemplary embodiment, the first channel formed in the lower central area of the breast and the second channel formed in the upper central area of the breast are in axial alignment with respect to one another and constitute a common channel.

Figure 5:
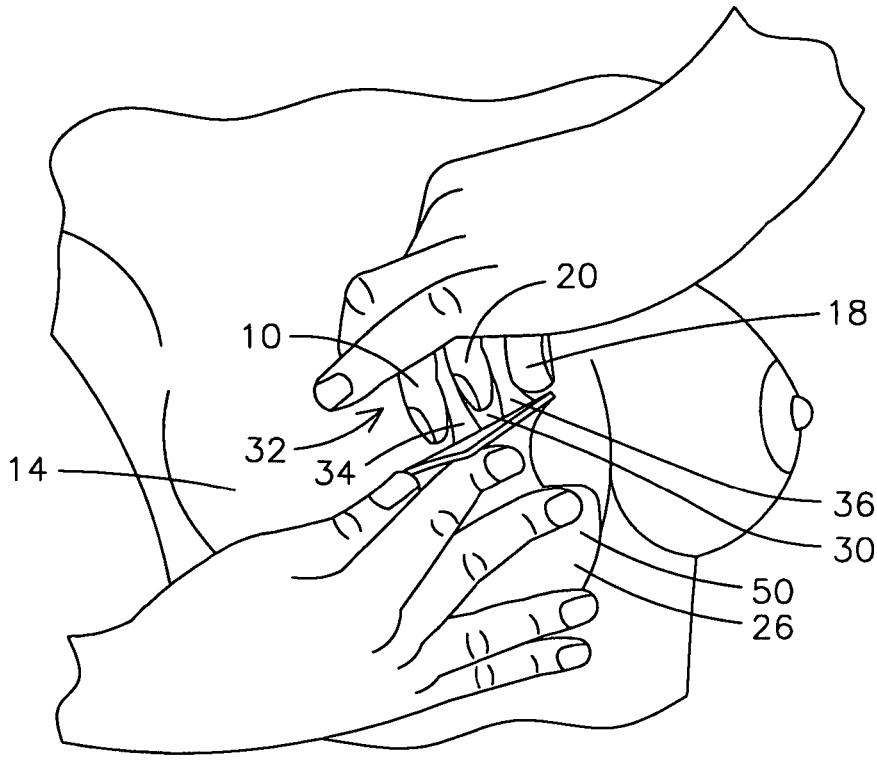

As shown in FIG. 5, the second finger 18 and the third finger 20 may then be used to bring together to a compressed condition a first fold 34 of breast mass and a second fold 36 of breast mass that are respectively formed along mutually opposite sides of the second channel 30, as the first finger presses against the upper central area 32 of the breast 14.

Figure 6:
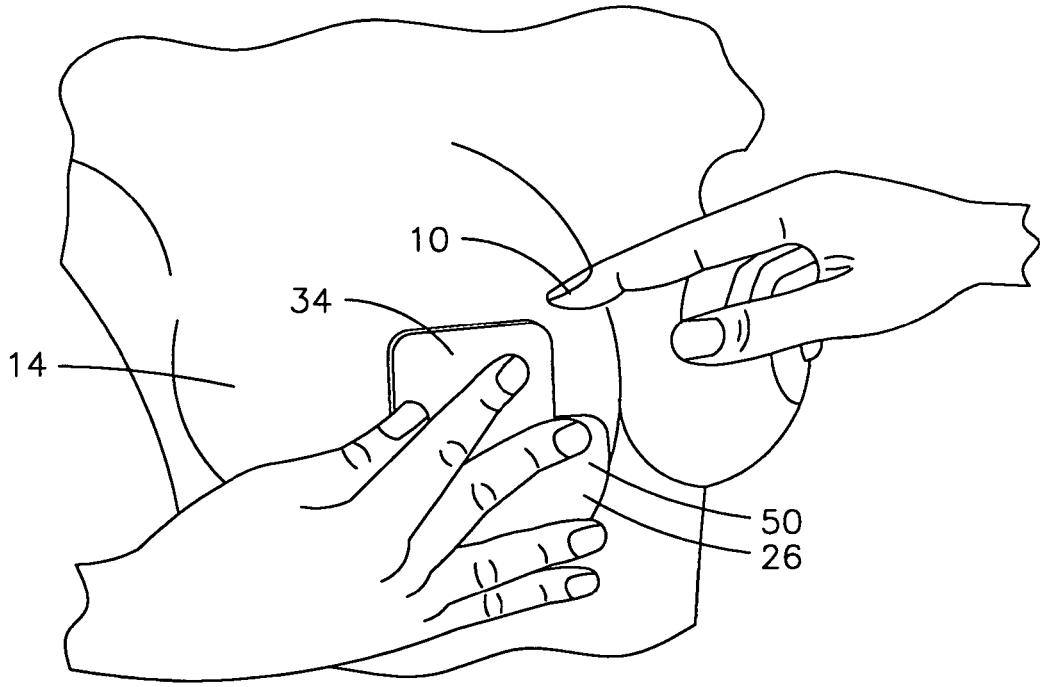

As shown in FIG. 6, a second section 34, such as a rectangular-shaped section, of the adhesive sheet is applied to the upper central area of the breast to maintain the compressed condition in the first and second folds of breast mass, upon release of the first finger 10 from the upper central area of the breast. Second section 34 corresponds to the lower section 54 that extends downwardly from upper section 52 in FIG. 7. It can be further appreciated from FIG. 7 (as well from example embodiments described below) that the surface area of the first (upper) section is relatively larger compared to the surface area of the second (lower) section.

Figure 7:
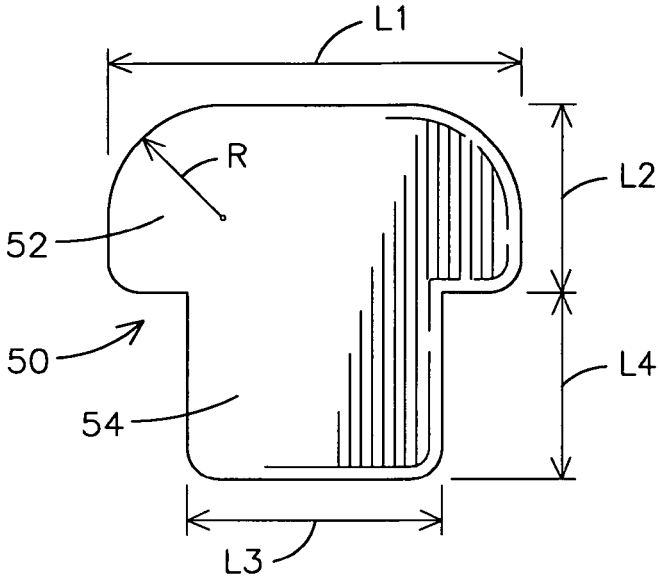
FIG. 7 is a view of a mushroom-shaped adhesive sheet as may be used for performing a method embodying aspects of the present invention.

In one exemplary embodiment illustrated in FIG. 7, an adhesive sheet, such as a mushroom-shaped adhesive sheet 50, that includes a curvilinear section 52 is configured to keep in a compressed condition a first fold and a second fold of breast mass formed in a lower central area of a breast. As described above and illustrated in FIG. 2, the first fold and the second fold are formed along mutually opposite sides of a first channel as a finger presses against the lower central area of the breast.

The mushroom-shaped adhesive sheet further comprises a rectangular-shaped section 54 configured to keep in a compressed condition a first fold and a second fold of breast mass formed in an upper central area of the breast. As described above and illustrated in FIG. 5, the first fold and the second fold are formed along mutually opposite sides of a second channel as a finger presses against the upper central area of the breast.

In one exemplary embodiment, the mushroom-shaped adhesive sheet may comprise a hypoallergenic, pressure sensitive adhesive (e.g., adheres just with finger or hand pressure) as may be coated on one side of a backing, such as non-woven backing, and may further comprise a liner, which is removed prior to applying the adhesive sheet. One example of a tape for medical applications suitable for practicing aspects of the present invention is commercially available from 3M Company, and is identified by 3M as product No. 9916. It will be understood that the present invention is not limited to this specific tape being that many other pressure sensitive adhesives used for medical applications can work equally effective, such as 3M product Nos. 9915 and 1776.

It is contemplated that aspects of the present invention may provide a suitable breast lift to women having up to a DD breast cup size. It will be appreciated that the adhesive sheet may comprise different dimensions and/or shapes to conformally accommodate and support any given breast size and/or shape. In one exemplary embodiment to accommodate B and C breast cup sizes, the curvilinear section of a mushroom shaped adhesive sheet may have a width (line L1) of approximately 4 in. and a length (line L2) of approximately 2.5 in., and the rectangular-shaped section may have a width (line L3) of approximately 2.5 in. and a length (line L4) of approximately 1.5 in. In another exemplary embodiment to accommodate D and DD breast cup sizes, the curvilinear section of a mushroom shaped adhesive sheet may have a width (line L1) of approximately 5.5 in. and a length (line L2) of approximately 3 in., and the rectangular-shaped section may have a width (line L3) of approximately 3.5 in and a length (line L4) of approximately 1.5 in. By way of example, the radii R for the curving edges of the curvilinear section can be selected to enhance a natural contour and support to the breasts, e.g., selected to follow the curving breast surface. Slits or cutouts may be optionally disposed along such edges to reduce wrinkle formation.

It is further contemplated that in accordance with additional aspects of the present invention, a kit may be provided for applying an adhesive sheet to a female human breast in conjunction with manipulations performed on the breast to provide lifting and shaping to the breast. In one exemplary embodiment, the kit includes a mushroom-shaped adhesive sheet comprising a curvilinear section and a rectangular section, as illustrated in FIG. 7.

The kit may further include a set of instructions, such as described and/or illustrated in the context of FIGS. 1-6, for applying the adhesive sheet to a female human breast in conjunction with manipulations performed on the breast to provide lifting and shaping to the breast. The mushroom-shaped adhesive sheet and the set of instructions may (but need not be) packaged together. Moreover, such instructions may be stored in a suitable digital storage medium, such as compact disk or digital video disk, and/or may be electronically delivered, such as by way of Internet delivery, and may be in the form of computer-readable code configured to provide a multimedia presentation to a user.

Figure 8:
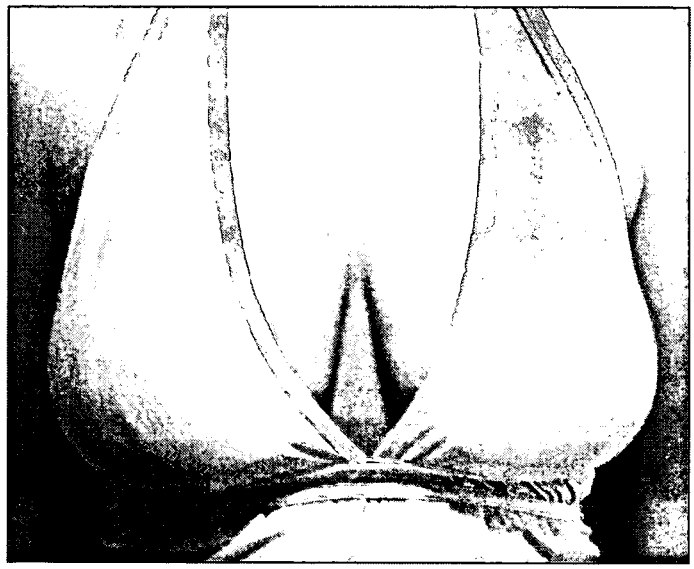
FIGS. 8 and 9 are photographic views that illustrate exemplary comparative results in a female model.
Figure 9:
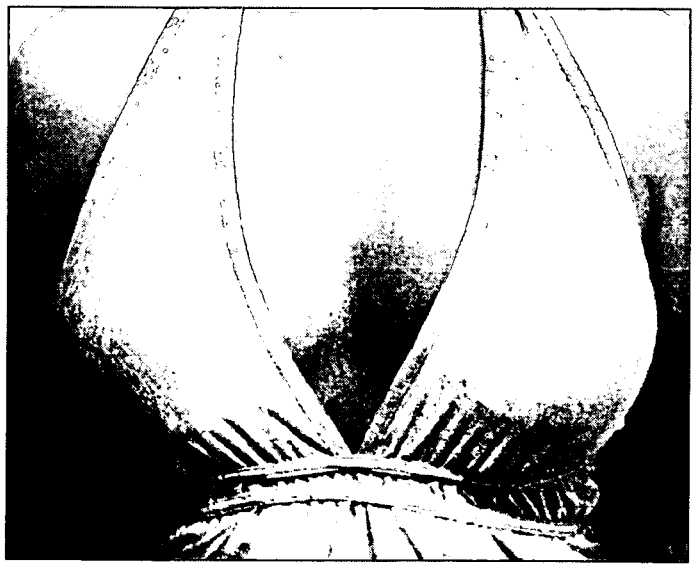

FIGS. 8 and 9 are photographic views that illustrate exemplary comparative results as may be viewed by an outside observer with respect to the female model seen in the views. More particularly, FIG. 8 shows a photograph of the model wherein her breasts are not lifted and shaped in accordance with aspects of the present invention. FIG. 9 shows a photograph of the same model wherein her breasts are lifted and shaped in accordance with aspects of the present invention.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

The invention claimed is:

1. A method for applying an adhesive sheet to a female human breast in conjunction with manipulations performed on said breast to provide lifting and shaping to said breast, said method comprising:

providing an adhesive sheet of a mushroom shape having a first wider, curvilinear upper section and a second narrow, rectangular lower section extending from the upper section;

pressing a first finger against a lower central area of a breast, said pressing forming a first channel in the lower central area of the breast;

using a second finger and a third finger to bring together to a compressed condition a first fold of breast mass and a second fold of breast mass that respectively form along mutually opposite sides of the first channel as the first finger presses against the lower central area of the breast;

applying the first section of the adhesive sheet to maintain the compressed condition in the first and second folds of breast mass upon release of the first finger from the lower central area of the breast;

pressing the first finger against a nipple area of the breast, said pressing forming a second channel in an upper central area of the breast;

using the second finger and the third finger to bring together to a compressed condition a first fold of breast mass and a second fold of breast mass that respectively form along mutually opposite sides of the second channel as the first finger presses against the upper central area of the breast; and applying the second section of the adhesive sheet to maintain the compressed condition in the first and second folds of breast mass upon release of the first finger from the upper central area of the breast.

2. The method of claim 1 wherein the first finger comprises an index finger.

3. The method of claim 2 wherein the second finger and the third finger respectively comprise a thumb finger and a middle finger.

4. The method of claim 1 wherein the step of pressing the first finger against the nipple area of the breast comprises pushing the nipple into the second channel.

5. The method of claim 1 wherein the first channel formed in the lower central area of the breast and the second channel formed in the upper central area of the breast are in axial alignment with respect to one another to constitute a common channel.

6. The method of claim 1 comprising actions self-performed by a female subject for lifting and shaping the breasts of said female subject.

7. A medical adhesive sheet to be applied to a female human breast in conjunction with manipulations performed on said breast to provide lifting and shaping to said breast, said adhesive sheet comprising:

a mushroom shape comprising a first upper curvilinear section configured to keep in a compressed condition a first fold and a second fold of breast mass formed in a lower central area of a breast, said first fold and said second fold formed along mutually opposite sides of a first channel as a finger presses against the lower central area of the breast; and the mushroom-shaped adhesive sheet further comprising a hypoallergenic, pressure sensitive adhesive and a second lower rectangular-shaped section extending downwardly from said upper section configured to keep in a compressed condition a first fold and a second fold of breast mass formed in an upper central area of the breast, said first fold and said second fold formed along mutually opposite sides of a second channel as a finger presses against the lower central area of the breast.

8. A kit for providing lifting and shaping to a female human breast, said kit comprising:

a mushroom-shaped medical adhesive sheet comprising a first upper curvilinear section and a second lower rectangular section extending downwardly from said upper section; and a medium including a set of instructions for applying the adhesive sheet to a female human breast in conjunction with manipulations performed on said breast to provide lifting and shaping to said breast; wherein the set of instructions comprises:

pressing an index finger against a lower central area of a breast, said pressing forming a first channel in the lower central area of the breast;

using a thumb and a middle finger to bring together to a compressed condition a first fold and a second fold of breast mass that respectively form along mutually opposite sides of the first channel as the index finger presses against the lower central area of the breast;

applying the first upper curvilinear section of the adhesive sheet to maintain the compressed condition in the first and second folds of breast mass upon release of the index finger from the lower central area of the breast;

pressing the index finger against a nipple area of the breast, said pressing forming a second channel in an upper central area of the breast;

using the thumb finger and the middle finger to bring together to a compressed condition a first fold and a second fold of breast mass that respectively form along mutually opposite sides of the second channel as the index finger presses against the upper central area of the breast; and applying the second lower rectangular-shaped section of the adhesive sheet to maintain the compressed condition in the first and second folds of breast mass upon release of the index finger from the upper central area of the breast.

9. The kit of claim 8 wherein the mushroom-shaped adhesive sheet and the set of instructions are separately packaged.

10. The kit of claim 8 wherein the set of instructions comprises computer-readable code.

11. The kit of claim 10 wherein the set of instructions comprises computer-readable code configured to provide a multimedia presentation.

12. The kit of claim 8 wherein the set of instructions for applying the adhesive sheet comprises manipulations self-performed by a female subject on her breasts to provide lifting and shaping to said breasts.

13. A medical adhesive sheet to be applied to a female human breast in conjunction with manipulations performed on said breast to provide lifting and shaping to said breast, said adhesive sheet comprising:

a mushroom shape comprising a first upper curvilinear section configured to keep in a compressed condition a first fold and a second fold of breast mass formed in a lower central area of a breast, said first fold and said second fold formed along mutually opposite sides of a first channel as a finger presses against the lower central area of the breast, wherein radii for curved edges of the curvilinear section are selected to follow a contour of a human breast; and the mushroom-shaped adhesive sheet further comprising a hypoallergenic, pressure sensitive adhesive and a second lower section extending downwardly from said upper section configured to keep in a compressed condition a first fold and a second fold of breast mass formed in an upper central area of the breast, said first fold and said second fold formed along mutually opposite sides of a second channel as a finger presses against the lower central area of the breast.

14. The adhesive sheet of claim 13 wherein the second lower section has a smaller surface area relative to the first upper section.

* * * * *